United States Patent [19]

Sheppard

[11] Patent Number: 4,872,251

[45] Date of Patent: Oct. 10, 1989

[54] FENDER FAST CLIP REMOVER

[76] Inventor: Harold A. Sheppard, 1432 Foxcroft Dr., Muskogee, Okla. 74403

[21] Appl. No.: 235,571

[22] Filed: Aug. 24, 1988

[51] Int. Cl.[4] ..... B25B 7/02

[52] U.S. Cl. ..... 29/243.56; 29/268

[58] Field of Search ..... 29/235, 243.56, 268; 81/420, 424.5, 426; 269/6

[56] References Cited

U.S. PATENT DOCUMENTS 1,106,439 8/1914 Conne ..... 81/426
2,126,225 8/1938 Simons ..... 29/243.56
4,386,543 6/1983 Walker ..... 29/268
4,658,489 4/1987 Johnston ..... 29/268

*Primary Examiner*—Robert C. Watson

[57] ABSTRACT

An automotive fender fast clip removing tool includes a plier-like frame having opposing jaws moved toward and away from each other by pivoting handles. A spring clip releasing jaw member, mounted on one jaw releases the clip and impinges it against a backup right angular member cooperatively disposed on the other jaw when inserted through a structure opening and disposed in contact with the fast clip.

4 Claims, 3 Drawing Sheets

FENDER FAST CLIP REMOVER

BACKGROUND OF THE INVENTION

1. Field of the Invention.

This invention relates to automotive upkeep or repair tools and more particularly to a fast clip remover.

Vehicles, such as automobiles, are provided with a screw threaded receiving element commonly called a "fast clip" and sometimes referred to as a "blind nut". The clip is installed in cooperative relationship with a bolt opening in one member, receiving the threaded end of a bolt from an adjacent member and secured together by the fast clip. In addition to being a time saving element the fast clip, which is semi-permanently secured to the vehicle, permits one member to be joined to another where a conventional bolt nut can not be installed on account of the physical space requirements.

The fast clip is formed from spring steel material and is generally U-shaped in side elevation for flat face to face contact by its leg members with opposite surfaces of a panel member having a bolt receiving aperture adjacent an edge thereof. The fast clip is cooperatively apertured transversely through its leg members which includes a struck-in spring member in one of its legs locking the fast clip in place by entering the panel aperture. The self-locking feature of these fast clips prevent their being easily removed, as for example, when replacing fenders.

2. Description of the Prior Art.

I do not know of any prior patent disclosing a tool for removing automotive fender fast clips.

SUMMARY OF THE INVENTION

A pair of handles are pivotally connected for movement toward and away from each other in plier-like fashion. The handles include opposing jaw portions projecting beyond the pivot axis for movement toward and away from each other in unison with the handle movement. One of the jaws forms an anvil or backup jaw against which the other or striker jaw is moved. The striker jaw supports a generally strap-like U-shaped member having one leg of its U-shape connected with, depending from and projecting laterally of the jaw with the other leg of the U-shape parallel with the laterally extending portion of the connected leg. The spacing between the U-shaped leg portions of the striker jaw slidably receives one side of a fender fast clip when the free leg of the striker U-shaped jaw is interposed between the clip and a panel. The anvil jaw supports a member substantially right angular in end elevation with one flange of the right angular member secured to the anvil jaw and its other flange projecting in a plane downwardly inclined with respect to the free leg of the U-shaped striker jaw. The right angular anvil jaw engages that side of a fender fast clip opposite the striker jaw during the fast clip removing action which is accomplished by forcing the handles toward each other when the jaws are respectively disposed on opposing sides of a fast clip.

The principal object of this invention is to provide an automotive fender fast clip removing tool for quickly and easily removing fast clips without damage thereto.

DESCRIPTION OF THE PREFERRED EMBODIMENTS

Figure 2:
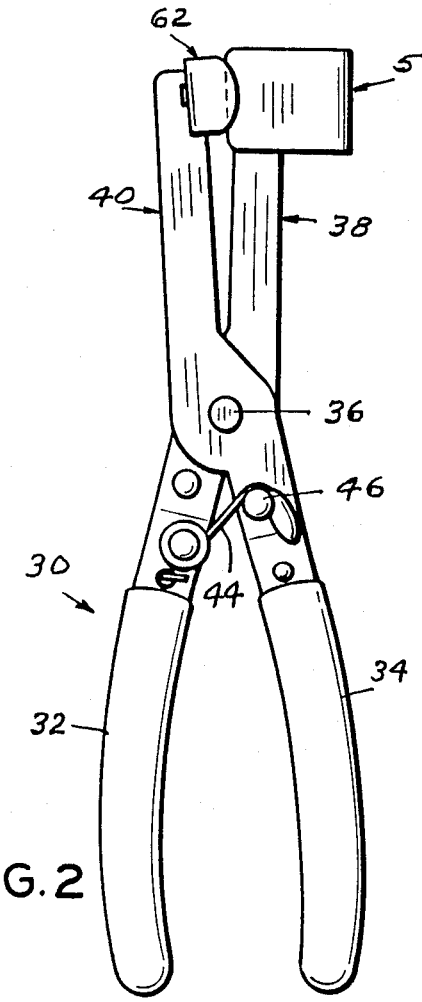
FIG. 2 is a bottom view of FIG. 1 with the jaws in closed position.

Like characters of reference designate like parts in those figures of the drawings in which they occur.

Figure 6:
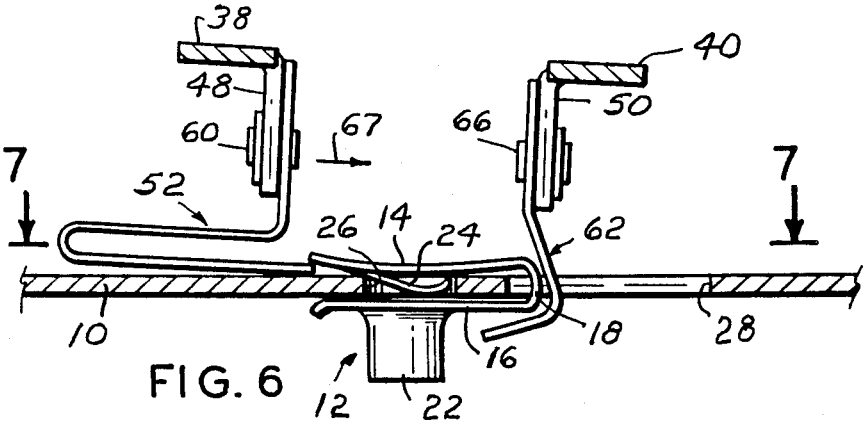
FIG. 6 is a fragmentary cross sectional view illustrating the jaws positioned for removal of a fast clip.
Figure 8:
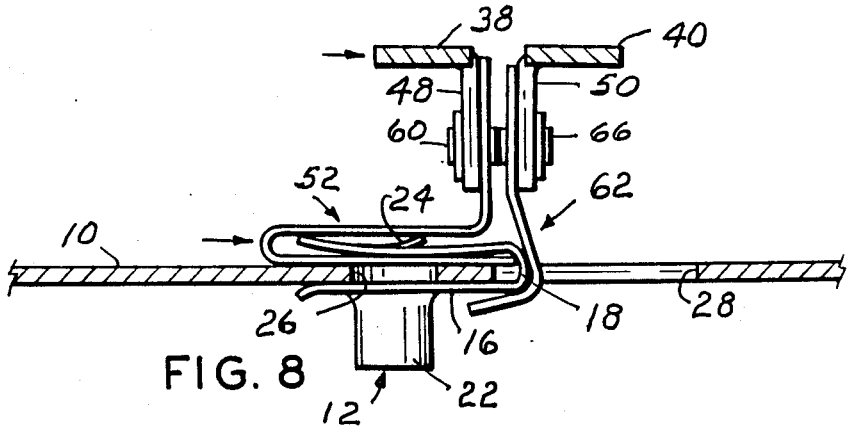
FIG. 8 is a view similar to FIG. 6 illustrating the jaws in fast clip released position.
Figure 9:
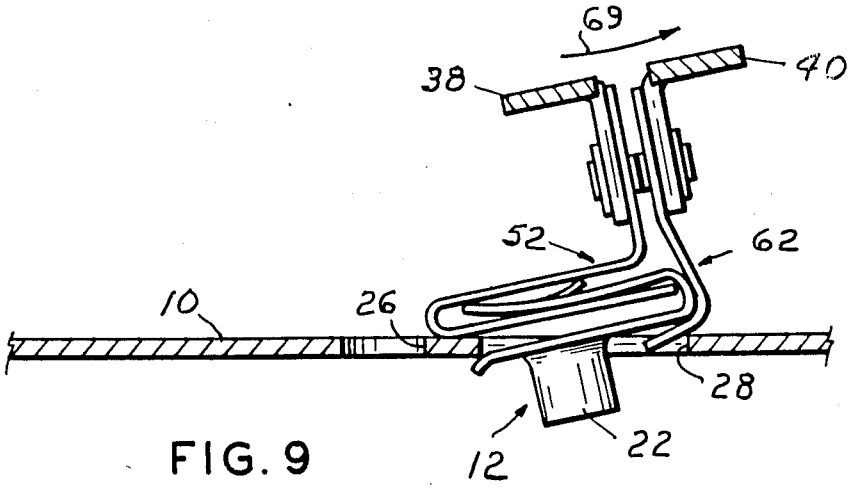
FIG. 9 illustrates the manner of removing the released fast clip from an automotive fender.
Figure 4:
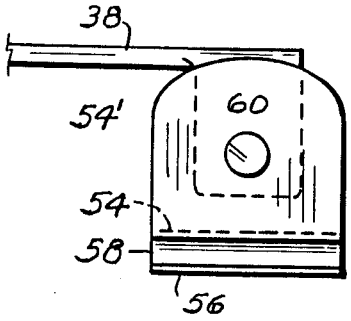
FIGS. 4 and 5 are fragmentary elevational views looking in the direction of the arrows 4—4 and 5—5, respectively, of FIG. 3.
Figure 5:
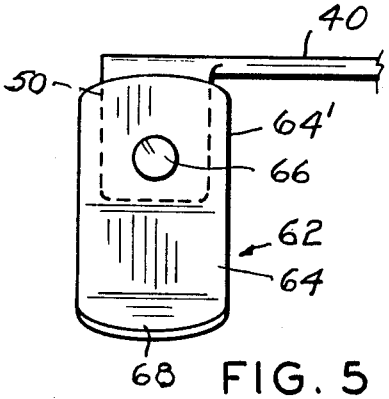
Figure 7:
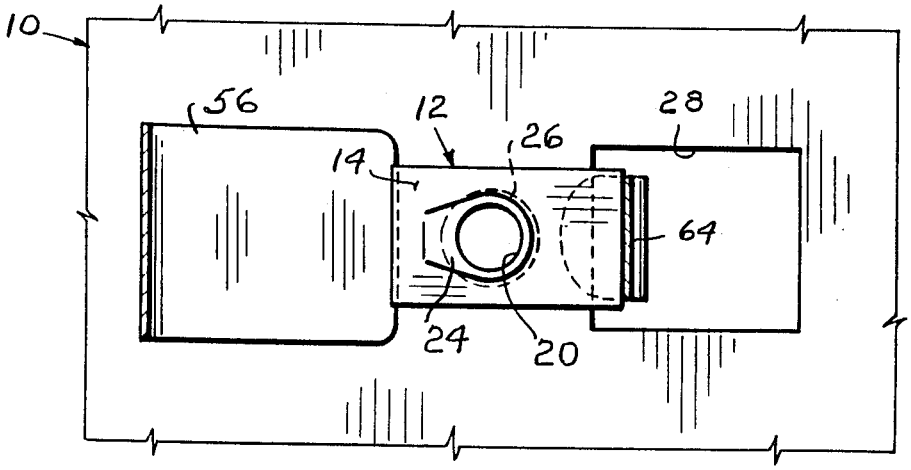
FIG. 7 is a fragmentary top view, partially in section, taken substantially along the line 7—7 of FIG. 6.

In the drawings:

Referring first to FIGS. 6 and 7, the reference numeral 10 indicates a fragment of a generally planar section of automotive fender or component which supports an automotive fender fast clip 12. The fast clip 12 is generally U-shaped in side elevation having a clamp leg 14 generally parallel with its companion screw thread supporting leg 16, the legs being joined by a bight portion 18. The clamp is preferably formed from spring steel material wherein the legs 14 and 16 are biased toward each other for frictionally gripping the panel 10 therebetween in the manner presently explained.

The legs 14 and 16 are transversely line drilled, as at 10, with an internally threaded socket 22 coaxial with the bore 20 secured to the surface of the leg 16 opposite the leg 14.

The leg 14 is provided with a struck-in flap 24 on a diameter slightly greater than the diameter of the bore 20 but smaller than the diameter of a bolt hole 26 formed in the panel member 10. The purpose of the flap 24 is to enter the panel hole 26 when the clip 12 has its bore 20 in register with the structure hole 26, as illustrated best by FIG. 6. The end portion of the flap 24, entering the hole 26, is arcuately curved upwardly, as viewed in FIG. 6, to normally prevent separation of the clip from the panel 10. The clip 12 is installed on the panel or structure 10 by inserting it through an aperture 28 formed through the panel 10 adjacent the hole 26. The above description is conventional with automotive fender fast clips and is set forth to show the combination with which the tool of this invention is used.

Figure 1:
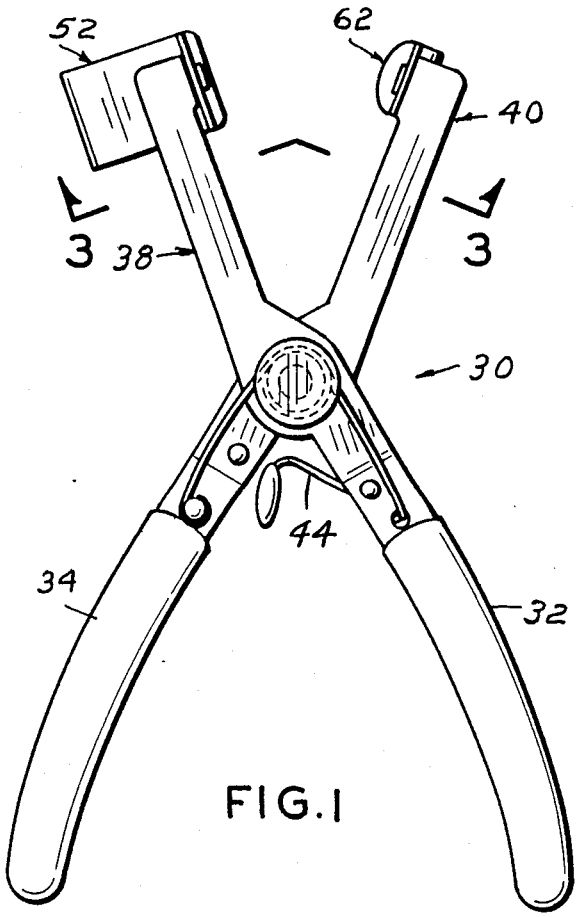
FIG. 1 is a top view of the tool with the jaws in open position.
Figure 3:
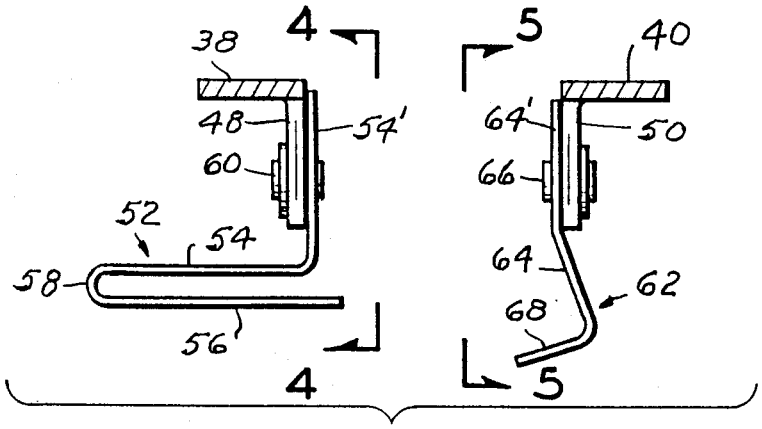
FIG. 3 is a vertical cross sectional view taken substantially along the line 3—3 of FIG. 1.

Referring also to the remaining Figures, the numeral 30 indicates the tool, as a whole, which is plier-like in general configuration comprising a pair of handles 32 and 34 pivotally interconnected by a pin 36 for movement of the handles toward and away from each other. The handles are respectively provided with jaw members 38 and 40 extending longitudinally beyond the respective handle for movement in unison with the handles toward and away from each other. The handles and jaws are normally biased apart to an open position, as illustrated by FIG. 1, by a spring member 42 having one end portion 44 which may be latched with a pin 46 to hold the handle-jaws in closed position, as illustrated by FIG. 2.

The free end portions of the jaws 38 and 40, hereinafter referred to as "striker" and "anvil" jaws, respectively, are each provided with a depending arm 48 and 50, respectively, normal to the plane of the respective jaw and in generally parallel relation with respect to the longitudinal axis of the respective jaw. When disposed in confronting relation, the legs 48 and 50 are substantially parallel, as viewed in FIGS. 6–9.

The striker jaw 38 further includes a strap metal clip release member 52, generally U-shaped in end elevation (FIGS. 4, 6, 8 and 9), having substantially parallel legs 54 and 56 joined by a bight portion 58 normally maintaining the legs 54 and 56 spaced-apart a distance sufficient to freely receive slidably the fast clip leg 14 therebetween. The leg 54 is upwardly extended, as at 54', normal to the plane of the leg 56 and is secured to the surface of the arm 48 facing the anvil jaw 40, as by a rivet 60.

The anvil jaw further includes a right angular backup member 62, when viewed in end elevation (FIGS. 5, 6, 8 and 9), having a length substantially equal with the width of the striker member 52, with one flange 64 of the right angle elongated, as at 64', and rigidly secured to the anvil jaw arm 50 by a rivet 66. The other flange 68 of the angular shape projecting toward the striker member 52 in a downwardly inclined relation so that the recess formed by the right angular shape nests the free end portion of the striker leg member 56 when the two jaws are in abutting relation ( FIGS. 8 and 9).

Operation

In operation, assuming the fast clip 12 is installed on the panel 10 as described hereinabove; the tool 30, with its handles and jaws spread apart, are disposed over the position of the fast clip 12; and, the right angular member of the anvil jaw is manually inserted into the panel aperture 28 with the angular flange disposed below the bight portion 18 of the fast clip (FIG. 6). The striker member 52, disposed on the opposite side of the fast clip 12, is disposed so that its leg 56 may be interposed, at its free end, between the adjacent end edge of the fast clip leg 14 and the surface of the panel 10. Manually forcing the handle 32 toward the handle 34 forces the striker jaw 38, in the direction of the arrow 62, toward the anvil jaw 40 wherein the leg 56 of the striker member 52, by sliding under the fast clip leg 14, lifts the spring flap 24 out of the bolt hole 26. The jaws 38 and 40 may then be moved into abutting relation wherein the striker jaw leg 56, contacting the inner surface of the fast clip bight portion 18, moves the outer surface of the clip bight portion 18 into contact with the right angular flange 64, thus gripping the spring clip. The striker member 52, backup angular member 62 and the fast clip 12 move as a unit in the direction of the arrow toward the panel aperture 28 and is removed from the panel in response to a lateral tilting movement, as illustrated by the arrow 69 in FIG. 9.

Figure 10:
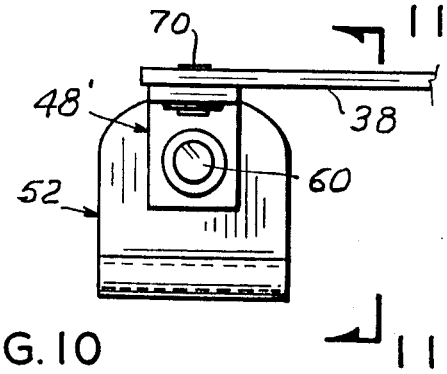
FIG. 10 is a fragmentary elevational view of an alternative embodiment of the tool striker jaw; and, FIG. 11 is an elevational view, partially in section, looking in the direction of the arrows 11—11 of FIG. 10.
Figure 11:
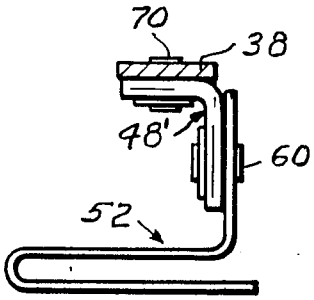

Referring more particularly to FIGS. 10 and 11, the striker member 52 may be connected with the jaw 38 for a horizontal pivoting movement of the striker member about a vertical axis in which a right angular member 48', similarly connected with the member 52 by one flange, is pivotally connected by a pin 70 extending vertically through the striker jaw 38. This pivotal connection of the striker member 52 facilitates fast clip removal for the reason that physical confines of the work area many times restricts the position of the longitudinal axis of the tool relative to the position of the fast clip 12.

Obviously the invention is susceptible to changes or alterations without defeating its practicability. Therefore, I do not wish to be confined to the preferred embodiment shown in the drawings and described herein.

I claim:

1. A fast clip removal tool, comprising:

a pair of handles pivotally connected intermediate their ends for movement of their respective end portions toward and away from each other;

an anvil jaw one end of one said handle; and, a striker jaw cooperatively disposed on one end portion of the other said handle for movement of said jaws toward and away from each other, said striker jaw being generally strap-like and U-shaped having one leg of the U-shape fixed to the said other handle end portion and having the other leg of the U-shaped projecting toward said anvil jaw, both said jaws cooperatively projecting laterally normal to the longitudinal axis of the respective said handle, said anvil jaw being substantially right angular in transverse section with one flange of the right angle secured to the one said handle and the other flange of the right angle projecting toward and inclined downwardly with respect to the plane of the striker jaw said other leg.

2. The tool according to claim 1 in which the legs of said striker jaw are planar and spaced apart a distance at least equal to the thickness of its respective leg.

3. In a removal tool for a fast clip of generally planar U-shape having the legs of the U-shape transversely apertured and cooperatively straddling an intermediate portion of a planar structure having a bolt receiving aperture, one leg of the clip having a lock flap spring biased, at one end, into the structure bolt aperture, the improvement comprising:

a pair of handles pivotally connected intermediate their ends for movement of their respective end portions toward and away from each other;

an anvil jaw on one end of one said handle; and, a striker jaw cooperatively disposed on one end portion of the other said handle for movement of said jaws toward and away from each other, said striker jaw being strap-like and generally U-shaped having a bight portion and having the end of one leg of the jaw U-shaped opposite the bight portion fixed to the said other handle end portion and having the end, opposite the bight portion, of the other leg of the jaw U-shape projecting toward said anvil jaw and slidably interposed between the lock flap equipped leg of the fast clip and adjacent surface of the planar structure for biasing said lock flap out of the structure bolt aperture when said handles are pivoted toward each other, both said jaws cooperatively projecting laterally normal to the longitudinal axis of the respective said handle, said anvil jaw being substantially right angular in transverse section with one flange of the right angle secured to the one said handle and the other flange of the right angle projecting toward the striker jaw and inclined downwardly with respect to the plane of the striker jaw said other leg.

4. The combination according to claim 3 in which the legs of said striker jaw are planar and spaced apart a distance at least equal to the thickness of the legs of the clip.

* * * * *